United States Patent [19]

Kishino et al.

[11] 4,047,074

[45] Sept. 6, 1977

[54] MULTI-DIGIT FLUORESCENT DISPLAY TUBE WITH CATHODE FILAMENT SUPPORT

[75] Inventors: Takao Kishino; Nobuo Yamaguchi; Yukihiko Utamura, all of Mobara, Japan

[73] Assignee: Futaba Denshi Kogyo Kabushiki Kaisha, Japan

[21] Appl. No.: 743,357

[22] Filed: Nov. 19, 1976

[30] Foreign Application Priority Data

Nov. 22, 1975 Japan ..... 50-157959[U]

[51] Int. Cl.[2] ..... H01J 1/18; H01J 1/72; H01J 1/94; H01J 63/06

[52] U.S. Cl. ..... 313/497; 313/513; 313/276; 313/278

[58] Field of Search ..... 313/496, 497, 495, 513, 313/278, 272, 279, 276, 269

[56] References Cited

U.S. PATENT DOCUMENTS

| | | | |
|---|---|---|---|
| 2,570,606 | 10/1951 | Simpson | 313/276 X |
| 3,723,789 | 3/1973 | Tanji | 313/278 X |

FOREIGN PATENT DOCUMENTS

| | | | |
|---|---|---|---|
| 2,347,283 | 3/1974 | Germany | 313/513 |
| 2,348,186 | 4/1974 | Germany | 313/497 |

*Primary Examiner*—Palmer C. Demeo

*Attorney, Agent, or Firm*—Oblon, Fisher, Spivak, McClelland & Maier

[57] ABSTRACT

A multi-column fluorescent display tube having a filament cathode provided opposite to a plurality of fluorescent display sections, which comprises at least a filament damper made of an insulating material low in thermal conductivity and having contact sections for supporting and stretching the filament cathode under tension at the middle portion of the filament cathode, and filament damper supporters so formed that it can prevent electrification of the surface of the filament damper.

1 Claim, 12 Drawing Figures

MULTI-DIGIT FLUORESCENT DISPLAY TUBE WITH CATHODE FILAMENT SUPPORT

The present invention relates to a multi-column fluorescent display tube (hereinafter sometimes referred to as a display tube) and, more particularly, to a filament-supporting structure thereof.

Examples of the prior art will be hereinafter described with reference to FIGS. 1 and 2 attached.

Reference is now made to FIG. 1, which shows an example of the conventional fluorescent display tube. In this example, the display tube is composed of a base plate 1, a plurality of pattern display sections 2 provided side by side on the upper surface of the base plate 1 and each consisting of a plurality of segment anodes each having a fluorescent layer thereon and adapted to selectively display a plurality of characters, figures, etc., a plurality of grids 3 provided opposite to the respective pattern display sections 2, a filament cathode 4 stretched over the pattern display sections 2 and the grids 3, and a casing 5 formed of a transparent glass tube or the like (or a metal casing having a transparent window on the front side thereof, not shown) and containing the above-mentioned elements.

Reference is now made to FIG. 2, which shows another example of the conventional fluorescent display tube. In this example, the display tube is composed of a base plate 11 formed of an insulator such as glass plate, a pattern display sections 12 provided side by side on the upper surface of the base plate 11 and each consisting of a plurality of segment anodes each having a fluorescent layer thereon and adapted to selectively display a plurality of characters, figures, etc., a plurality of grids 13 provided opposite to the respective pattern display sections 12, a filament cathode 14 stretched over the pattern display sections 12 and grids 13, and a cover plate 15 made of transparent glass or the like which may be flat-plate-shaped or flat-bottomed-boat-shaped, the cover plate 15 being airtightly bonded to the base plate 11 directly or with a spacer therebetween to form a casing 16.

In the above-mentioned conventional fluorescent display tube, the filament cathode 4 or 14 may be provided for each of a plurality of pattern display sections; but, as shown in FIGS. 1 and 2, it may be made common to all the pattern display sections 2 or 12 by providing it longitudinally along the pattern display sections 2 or 12 and orthogonally to the axis of a pattern display on each display section 2 or 12. In the latter case where the filament cathode is so made that it becomes common to all the display sections, it may usually consists of one or two filaments and therefore can be made simple in construction and requires only reduced man-hours in production. However, in this case, when the characters and numerals to be displayed are large in size and the number of the display sections or columns is large, the filament provided is inevitably increase in length and tends to decrease its resistance against shock and vibration, and becomes liable to disconnection and, in addition, the electron-emitting material layer coated on the filament (e.g., oxide coating) becomes liable to peel off.

In order to improve the resistance of the above-mentioned filament to shock and vibration, there has been proposed a fluorescent display tube which has a filament supporter formed of a thin metal wire or the like provided at the middle of, under and in the vicinity of the filament and adapted to prevent vibration of the filament. However, such a filament supporter cannot satisfactorily produce anti-shock and anti-vibration effects, since it cannot achieve a perfect support of the filament for the following reasons:

In a usual fluorescent display tube in which the pattern display sections for displaying characters and figures are arranged at regular intervals in a relatively limited space, the preferable operating temperature of the filament is usually considered to be about 700° C. When the filament supporter provided at the middle of the filament comes into contact with the filament kept at about 700° C, the portion of the filament in contact with the filament supporter decreases in temperature and therefore cannot emit electrons satisfactorily with the result that the display sections in the vicinity of the filament supporter are decreased in display brightness thereby causing uneven brightness between each display section or column.

In consideration of the above-mentioned disadvantages of the conventional filament supporter, the inventor has proposed a filament supporter which is made of an insulating material low in thermal conductivity thereby preventing the above-mentioned temperature decrease of the filament and remarkably improving the above-mentioned uneven brightness between each display section or column. However, even in this case, some problems still remain unsolved as shown in the following:

Electrons emitted from the filament tend to gather on the surface of the supporter formed of an insulating material low in thermal conductivity thereby exerting an influence on the electric field between the filament and the display sections with the result that the electron current from the filament to the display section is disturbed and therefore uniform electron bombardment on the display section is hampered resulting in uneven brightness of the display.

It may be a possible method of eliminating the above-mentioned uneven brightness or light emission to increase the interval between the display sections positioned near the above-mentioned filament supporter. However, this method will produce an unnatural space between the display sections or columns in the central region and therefore is not suitable for use in producing a multi-column fluorescent display tube.

Therefore, the present invention contemplates to eliminate the above-mentioned disadvantages of the prior art.

It is the primary object of the present invention to provide a multi-column fluorescent display tube in which a filament cathode longitudinally provided under tension opposite to a plurality of display sections is supported fully safely at the middle portion thereof, no unnatural spaces are produced between the display sections or columns positioned near the filament-supporting portion and uniform brightness or light emission is ensured at the display sections positioned near the filament-supporting portion.

According to the present invention, there is provided a multi-column fluorescent display tube having a filament cathode provided longitudinally along and opposite to a plurality of fluorescent display sections, which comprises at least one filament damper made of an insulating material low in thermal conductivity and having contact sections for supporting the filament cathode under tension at the middle of the filament cathode, and filament damper supporters so formed that it can prevent electrification of the surface of the filament damper.

Now the present invention will be hereinafter described in detail with reference to the accompanying drawings in which.

Figure 8:
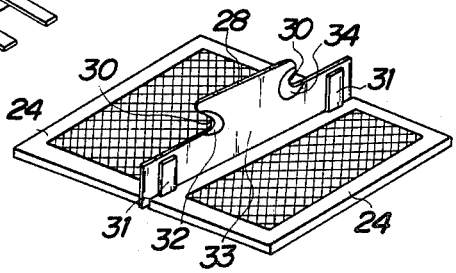
Figure 5:
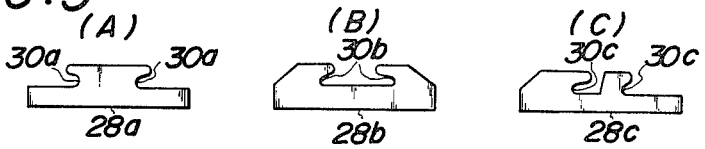
Figure 6:
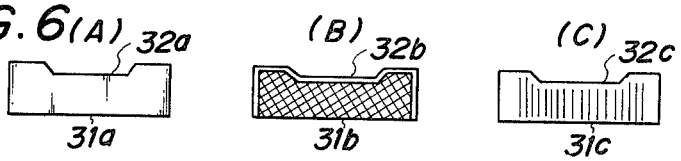
Figure 7:
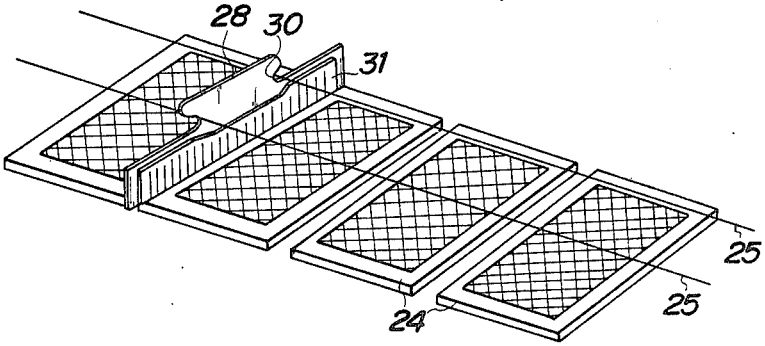

FIGS. 5(A), 5(B) and 5(C) are side views of the essential parts of various filament dampers for use in a multi-column fluorescent display tube according to the present invention, respectively;

FIGS. 6(A), 6(B) and 6(C) are side views of the essential parts of various supporters for use in a multi-column fluorescent display tube according to the present invention:

FIG. 7 is an enlarged perspective view of the essential part of a multi-column fluorescent display tube according to another embodiment of the present invention; and FIG. 8 is an enlarged perspective view of the essential part of a multi-column fluorescent display tube according to the third embodiment of the present invention.

Figure 1:
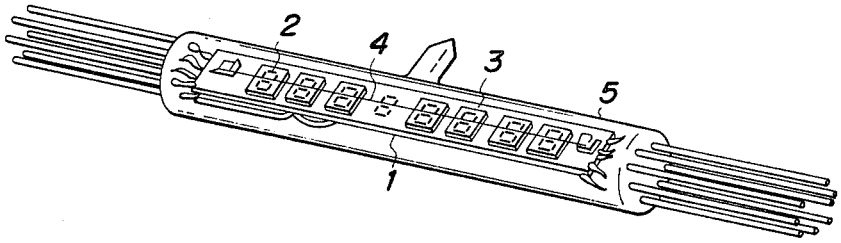
FIG. 1 (PRIOR ART)
FIG. 1 is a perspective view of an example of a conventional multi-column fluorescent display tube.
Figure 2:
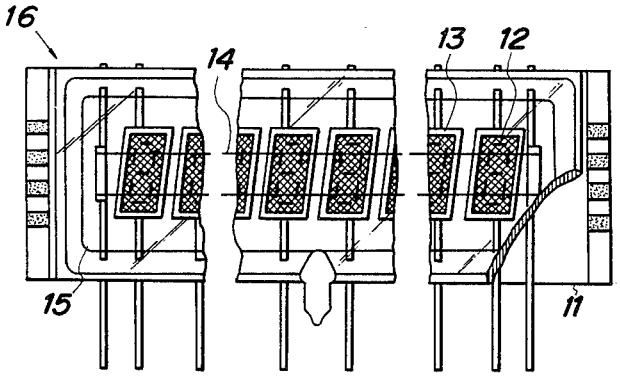
FIG. 2 (PRIOR ART)
FIG. 2 is a partially cutaway plan view of another example of a conventional multi-column fluorescent display tube.
Figure 3:
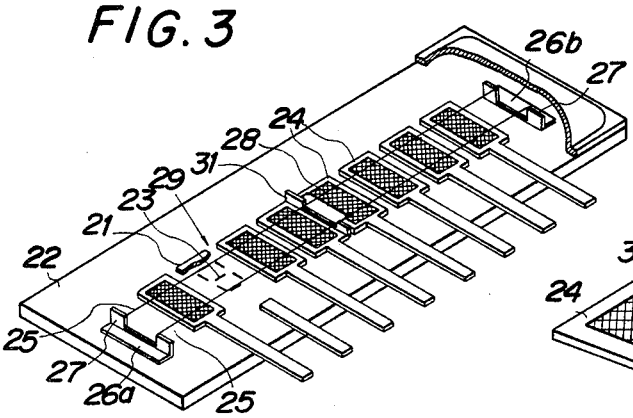
FIG. 3 is a perspective view of the essential part of a multi-column fluorescent display tube according to one embodiment of the present invention.
Figure 4:
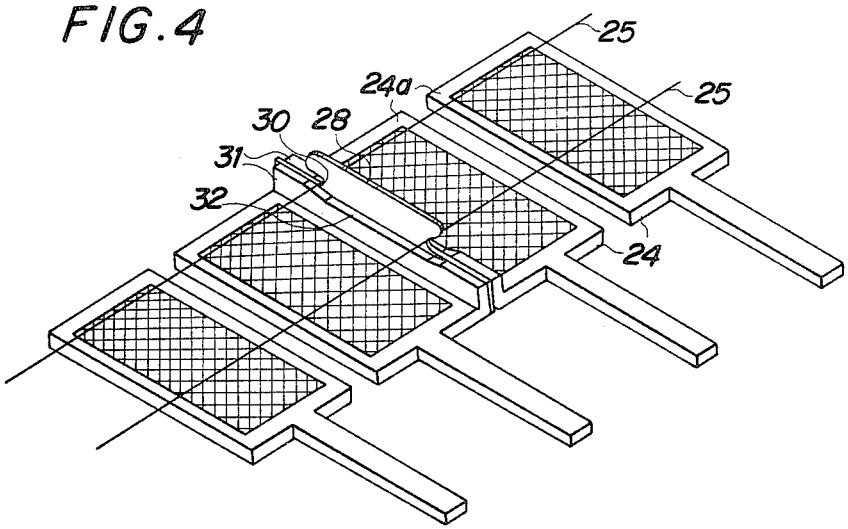
FIG. 4 is an enlarged perspective view of the essential part shown in FIG. 3.

Reference is now made to FIGS. 3 and 4 which show the essential part of a multi-column fluorescent display tube according to the present invention.

In the drawings, Reference numeral 21 designates a plurality of display sections provided side by side on the upper surface of a base plate 22 and each consisting of a plurality of segment anodes 23 and adapted to selectively display a plurality of characters, figures, etc. Each of the segment anodes 23 has a fluorescent layer thereon. Reference numeral 24 designates a plurality of grids each disposed opposite to the corresponding display section 21. Numeral 25 designates a filament cathode consisting of one or a plurality of filaments (shown are two filaments) disposed opposite to and a predetermined distance apart from the respective display sections 21 and to which tension is given by a resilient force produced by mounting sections 27 provided on filament supports 26*a* and 26*b* fixed at both longitudinal ends of the base plate 22. In addition, the filament or filaments 25 are provided orthogonally to the axes of the pattern characters of the display sections 21. Moreover, the filament 25 is coated with a coating material high in electron-emitting capacity.

Numeral 28 designates one or a plurality of filament dampers provided midway between the mounting sections 27 and 27 to which the filament cathode 25 is fixed. The filament damper 28 is provided with contact sections 30 having concave recesses so formed that they may come into contact with the middle portion of the filament 25 provided in parallel with the display surface 29 and thereby urge it slightly toward the display surface 29. More particularly, the contact sections 30 formed on the filament damper 28 urges the middle portion of the filament 25, provided in parallel with the display surface 29 and tightly stretched by the resilient force produced by the mounting sections 27, slightly toward the display surface 29 maintaining substantially the parallel and predetermined-distance relations therebetween and, in addition, substantially vertically to the filament 25. Thus the filament 25 is slightly bent at the contact portion. The filament damper 28 is made of an insulating material low in thermal conductivity, that is, having a thermal conductivity of $20 \times 10^{-3}$ J/cm·S·K or less, preferably, $10 \times 10^{-3}$ J/cm·S·K or less such as mica, porcelain or glass. In an example of the present invention, successfully used is a thin mica plate about 0.2 mm thick and having a thermal conductivity of about $6 - 7 \times 10^{-3}$ J/cm·S·K.

The filament damper 28 and the contact section 30 formed on the filament damper 28 may be of any shape, if they can come in contact with and hold the middle portion of the filament 25 provided in parallel with the display surface 29 and tightly stretched by the resilient force produced by the mounting sections 27 of the filament supports 26*a* and 26*b* positioned at the both ends of the filament 25 so that they may maintain a predetermined distance between the filament 25 and the display surface 29, and so that they may prevent vibrations of the filament 25 having large amplitudes occurring with the both-end mounting sections 27 as fixed points, especially those of the filament 25 large in amplitude occurring vertically to the display surface 29. For instance, when the number of the filaments 25 is two, the filament dampers may assume any shapes such as those indicated by 28*a*, 28*b* and 28*c* shown in FIGS. 5(A), 5(B) and 5(C), respectively. The filament damper 28*a* shown in FIG. 5(A) is formed so that the two contact sections 30*a* having concave recesses may support and hold the two filaments 25 by separating the middle portions of the filaments 25 slightly outwardly. The filament damper 28*b* shown in FIG. 5(B) is formed so that the two contact sections 30*b* having concave recesses may support and hold the two filaments 25 by making the distance between the middle portions of the filaments 25 slightly narrower. The filament damper 28*c* shown in FIG. 5(C) is formed so that the two contact sections 30*c* having concave recesses may support and hold the two filaments 25 by urging the middle portions of the filaments 25 simultaneously upward or downward.

The contact section 30 for supporting the middle portion of the filament 25 may assume any shapes such as semi-circular and triangular in section if the bottom portion thereof with which the filament 25 comes into contact has a circular shape in section larger in diameter than the filament 25, as a matter of course. The contact area between the filament 25 and the contact section 30 is preferably as small as possible. For this reason, the above bottom portion of the contact section 30 preferably has, for instance, a sectional shape provided with roundness at its end. When a mica plate is used, the contact section 30 may be about 0.1 to 0.5 mm thick, preferably about 0.15 to 0.25 mm thick.

Numeral 31 designates supporters for the filament damper 28, each of which is formed of a thin conductive metal sheet. The supporters 28 are disposed so that they may hold the filament damper 28 therebetween. These right and left supporters 31 and 31 are fixedly bonded at the lower edges thereof to the opposed sides of the frames 24*a* and 24*a* of the adjacent right and left grids 24 and 24. Each supporter 31 may be formed integrally with the grid 24 by bending it vertically to the grid 24 by pressing or the like. Therefore the materials of the supporter 31 and the grid 24 are preferably the same, but may be different. The supporter 31 is formed so that it may come in contact with almost all the side wall surface of the above filament damper 28 except the portion in the vicinity of the above contact section 30.

In addition, the supporter 31 is provided, at the middle portion of the upper edge thereof, with a recess 32 so that the height thereof at that portion may become lower by about 0.2 to 0.5 mm than that of the portion where the filament damper 28 comes in contact with the filament 25. The supporter 31 may be properly changed in shape according to the shape of the filament damper 28 which it supports, as a matter of course. For instance, as shown in FIGS. 6(A), 6(B) and 6(C), the supporter 31 may assume any shapes such as those indicated by 31*a*, 31*b* and 31*c*. The supporter 31*a* shown in FIG. 6(A) is formed of a thin flat metal sheet produced by blanking. The supporter 31*b* shown in FIG. 6(B) is produced by forming a net-shaped area on the metal sheet shown in FIG. 6(A) except the peripheral edge thereof. The supporter 31*c* shown in FIG. 6(C) is produced by forming a number of vertical slits on the metal sheet shown in FIG. 6(A). In the case of the supporter 31*a* shown in FIG. 6(A), the filament 25 tends to lower in temperature at the portions thereof in contact with the filament damper 28; however, such a slight temperature drop poses no practical problem. In the case of the supporter 31*b* or 31*c*, more sufficient effects can be expected. In an example of the present invention, the supporter 31*a* shown in FIG. 6(A) was used in combination with the filament damper 28 formed of a mica plate with very good results.

The filament-supporting section according to the above-mentioned embodiment is assembled as follows:

The grids 24 each provided with a supporter 31 formed vertically thereto and integrally therewith at one side-edge portion thereof are mounted on the display surfaces 29 and 29 positioned at the right and left sides of the mounting position of the filament damper 28, respectively, with the supporter sides positioned inside and opposite to each other. Then the filament damper 28 is arranged so that it may be held between the supporters 31. In this case, a bonding agent such as low melting-point frit glass may be used to ensure the stable connection between the filament damper 28 and the supporter 31 thereby stabilizing the mounting condition of the filament damper 28.

In the above-mentioned embodiment, the filament 25 is supported and held by the contact section 30 of the filament damper 28 which is in contact with the filament 25 through a very limited area and made of an insulating material low in thermal conductivity, and therefore the filament 25 shows a very small temperature drop at the contact portion thereof. In addition, the contact section 30 ensures the sure holding of the filament 25, and thereby remarkably decreases vertical and horizontal vibrations. Moreover, the coating material coated on the filament 25 is prevented from peeling off, and the brightness flickering of the display section 21 is completely eliminated.

As mentioned above, if the surface of the filament damper 28 is electrified with electrons emitted from the filament 25, electron current from the filament and the display surface is disturbed and thereby the uniform bombardment of electrons on the display surface is hampered resulting in uneven light emission. However, according to the above construction of the present invention, the surface of the filament damper 28 is not electrified with electrons coming into collision therewith. These electrons are discharged to the grid 24 through the supporter 31. Therefore no uneven light emission is created.

In the above embodiment, the supporter 31 is formed integrally with the grid 24, and therefore special holders and the like are not necessary for fixing the filament damper 28 with the result that the number of parts and the man-hours of operations can be reduced.

In the second embodiment shown in FIG. 7, the filament damper 28*a* shown in FIG. 5(A) is used in combination with the supporter 31*c* shown in FIG. 6(C). In other respects, the second embodiment is the same as the first embodiment. Therefore, the detailed description of the second embodiment will be omitted.

Reference is now made to FIG. 8 which shows the third embodiment of the present invention. In this embodiment, conductive surface areas 33 are formed by nesa-film treatment or the like on all the peripheral surfaces of the filament damper 28 except the non-conductive surface areas 34 at and near the contact surfaces of the contact sections 30. The supporters 31 are of a small strip shape and formed on the corresponding side edges of the grids 24 and vertically thereto.

In the third embodiment, the non-conductive areas 34 and the conductive surface areas 33 may be formed by conducting the nesa-film treatment with the non-conductive surface areas covered with masks or the like. The supporter 31 can be made very small and thereby the weight burden imposed on the grid 24 can be decreased.

It will be understood from the foregoing description that the present invention has the following advantages:

Since the filament is supported and held at its middle portion by the contact section of the filament damper made of an insulating material low in thermal conductivity, the temperature drop of the filament at the above holding portion is very small and therefore uneven brightness of the fluorescent display sections caused by the above holding portion can be considerably eliminated and, in addition, flickering of brightness due to vibrations of the filament is also completely eliminated. Since electrons coming into collision with the surface of the filament damper are immediately discharged by provision of the supporter, very clear, stable and uniform fluorescent display can be obtained without uneven light emission.

Since the provision of the filament damper can surely prevent the filament from vibrational shocks due to large external impact, flickering of the brightness is completely eliminated as mentioned above and, in addition, disconnection of the filament and peeling-off of the oxide coating due to vibration can be satisifactorily prevented.

Since the supporter of the filament damper can be formed integrally with the grid, the number of parts and the man-hours of operation can be greatly reduced.

What is claimed is:

1. In a multi-column fluorescent display tube having at least a vacuum container, a base plate provided in said vacuum container, a plurality of display sections provided on said base plate side by side in the longitudinal direction of said base plate, each of said display sections having a fluorescent material layer thereon, and a filament cathode provided opposite to said plurality of display sections and tightly stretched in the longitudinal direction; the improvement which comprises at least a filament damper made of an insulating material low in thermal conductivity and having contact sections for slightly urging the middle portion of said filament cathode substantially vertically to said filament cathode maintaining substantially parallel relations with the surface of said display sections so that said filament cathode may be tightly stretched, filament damper supporters made of conductive material and bonded to the peripheral wall surfaces of said filament damper except at least said contact sections, and said supporters being connected to conductive sections such as grid electrodes thereby preventing electrification of the surface of said filament damper.

* * * * *